United States Patent [19]

Hasegawa et al.

[11] Patent Number: 4,489,461

[45] Date of Patent: Dec. 25, 1984

[54] METHOD AND APPARATUS FOR TEXTILE FIBER DRAFTING

[75] Inventors: Junzo Hasegawa, Oobu; Susumu Kawabata, Aichi; Mitsunori Horiuchi, Kariya; Yoshihisa Suzuki, Chiryu, all of Japan

[73] Assignee: Kabushiki Kaisha Toyoda Jidoshokki Seisakusho, Kariya, Japan

[21] Appl. No.: 435,265

[22] Filed: Oct. 19, 1982

[30] Foreign Application Priority Data

Oct. 24, 1981 [JP] Japan ..... 56-170472

[51] Int. Cl.[3] ..... D01H 5/74

[52] U.S. Cl. ..... 19/258; 19/286; 19/288

[58] Field of Search ..... 19/258, 266, 286, 288

[56] References Cited

U.S. PATENT DOCUMENTS

| | | | |
|---|---|---|---|
| 1,433,529 | 10/1922 | Butler | 19/286 |
| 2,238,659 | 4/1941 | Reynolds | 19/288 X |
| 2,244,461 | 6/1941 | Kettley | 19/258 |
| 2,773,297 | 12/1956 | Cotchett | 19/288 X |
| 3,006,037 | 10/1961 | Bettolo | 19/258 |

FOREIGN PATENT DOCUMENTS

| | | | |
|---|---|---|---|
| 310958 | 4/1929 | United Kingdom | 19/286 |
| 800432 | 8/1958 | United Kingdom | 19/258 |

*Primary Examiner*—Louis K. Rimrodt

*Attorney, Agent, or Firm*—Brooks Haidt Haffner & Delahunty

[57] ABSTRACT

A novel fiber drafting system is disclosed, according to which fibers of sliver supplied continuously are passed through a first pair of rotatable cooperating rollers while being pressed and compacted into a reduced section by and between a space formed by a groove and a projection formed respectively in and on the circumferential peripheries of the rollers of said first pair. The sliver thus compacted is then transferred to and held by and between a second pair of rollers rotated at a higher peripheral speed than the first pair of rollers, whereby the fibers of sliver are drafted successively between the two pairs of rollers without use of conventional aprons for guiding and supporting the fibers in the drafting zone.

12 Claims, 12 Drawing Figures

METHOD AND APPARATUS FOR TEXTILE FIBER DRAFTING

BACKGROUND OF THE INVENTION

The present invention relates generally to a textile fiber drafting system. More specifically, it relates to provision of novel method and apparatus of drafting fibers of sliver, roving or the like which uses at least two pairs of top and bottom rollers and are utilized in combination with a ring spinner or a spinning frame for producing fasciated yarn.

In drafting fibers of sliver, roving or the like by means of a roller drafting mechanism including a pair of back rollers and another pair of front rollers rotating at a higher peripheral speed than said pair of back rollers, it is known that, for the purpose of minimizing irregularity in draft, a control must be provided for those fibers which are too short to be held by either nip of said pairs of back and front rollers through the use of any sliver guide means, e.g., that which is known as the Casablancas type arrangement, designed to support and guide such free short fibers in the drafting zone. This known guide device, which comprises a pair of rubber aprons trained over the peripheral surfaces of the back rollers, respectively, and driven to move at an identical speed, is designed and arranged to hold the sliver softly therebetween and transfer the same toward the high-speed running front rollers. Though this guide device can provide very effective support for the free short fibers in the sliver, a fiber drafting operation which uses such aprons has posed various problems associated therewith. These problems include damage or even fraying of the aprons due to their buckling motion at an acute angle adjacent to the fast running front rollers, damage thereto due to abnormal friction caused by entanglement of lint or fiber pieces around the aprons, etc. In a high-speed drafting arrangement used in combination with a spinner for producing fasciated yarn, in particular, a continuous drafting operation using such aprons without stopping (for 24 hours of operation in a day) for about one month at a peripheral speed of 150 meters per minute of the faster running rollers, causes the aprons to be broken eventually, thus showing poor strength and durability of the aprons which renders them inadequate for practical application.

SUMMARY OF THE INVENTION

The primary object of the present invention, therefore, lies in making possible the avoidance of the use of such frayable elements such as the aforementioned aprons which cannot withstand service for a substantial period of time, while accomplishing an equal degree of uniformity in the drafting of the fibers while using only two pairs of drafting rollers, as compared with that obtainable from the conventional drafting system having fiber supporting aprons.

Another object of the present invention is to make possible the drafting of fibers successfully by the use of an extremely simple method and apparatus, while attaining the same level of high-seed drafting and of reduced irregularity in the draft in the conventional system which uses aprons.

Still another object of the present invention is to provide a fiber drafting apparatus which can bear an extended period of continuous and successful drafting service and which contributes to improvement in the ease of control and maintenance of the apparatus.

All these objects can be accomplished by the present invention according to which sliver, or a bundle of fibers supplied continuously, is pressed through its sectional plane across the direction of movement thereof by and between a first pair of driven bottom and top rollers formed so as to compact said sliver, thereby to increase the friction between the fibers in the sliver. The fibers thus compacted into a reduced cross-section are then transferred to a second pair of driven rollers where the compacted sliver is nipped therebetween and simultaneously delivered out at a speed which is more than 20 times higher than the speed at which the sliver was transferred by said first pair of rollers. Thus, the fibers in the sliver are drafted and separated in the drafting zone between the first nip provided by the first pair of pressing rollers and the second nip provided by the second pair of rollers.

When the invention is to be used in combination with a ring spinning machine, it is desirable that the sliver be compacted in such a way that the cross-section thereof is reduced to a sectional form similar to that prior to being pressed by said first pair of rollers. When used in combination with a spinning machine for producing fasciated yarn, on the other hand, the sliver should be desirably so compacted that the cross-section thereof is flattened by said first pair of rollers. By do doing, the number of wrapping fibers in a fasciated yarn can be increased with resulting production of better quality yarn.

In order to press and compact the sliver in an embodiment of the present invention, the circumferential peripheries of the first pair of rollers which are supported rotatably about their respective axes parallel to each other are formed at their medial part with an annularly recessed groove and a corresponding annular projection, respectively, with a space formed at the point of engagement of said groove and said projection, the cross-section of said space being similar to a desired section of the sliver to be obtained after receiving compacting action by said first paired rollers. In such formation of the first roller arrangement, compaction of the sliver is accomplished merely by feeding the same into and through said space formed by the engagement of said groove and said projection. It is desirable that the ratio of compaction, or the ratio of the sectional area of said space to the sectional area of unpressed sliver, be established somewhere between $\frac{1}{3}$ and 1/50, or preferably between 1/5 and 1/20. When pressing the sliver at a relatively high compaction ratio in the above-mentioned range, provision of a collector at a position upstream of said first pair of pressing rollers is helpful, said collector having a through-hole opened along the movement of the sliver, whose inlet for the sliver is formed slightly larger in cross-section than the sliver just being introduced thereinto and whose outlet adjacent the first pair of pressing rollers has a width that is substantially equal to or smaller than that of said space for guiding and collecting the sliver in advance of feeding the same to the pressing rollers.

The above and other objects, features and advantages of the present invention will become more apparent to those skilled in the art from the following detailed description of preferred embodiments of the invention, taken in conjunction with the accompanying drawings, wherein:

DETAILED DESCRIPTION OF THE PREFERRED EMBODIMENT

Figure 1A:
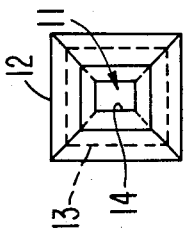
FIG. 1A is a view as seen from lines 1A—1A in FIG. 1.
Figure 1B:
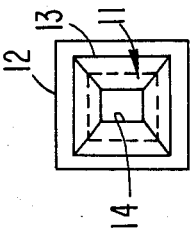
FIG. 1B is a view as seen from lines 1B—1B in FIG. 1.
Figure 1:
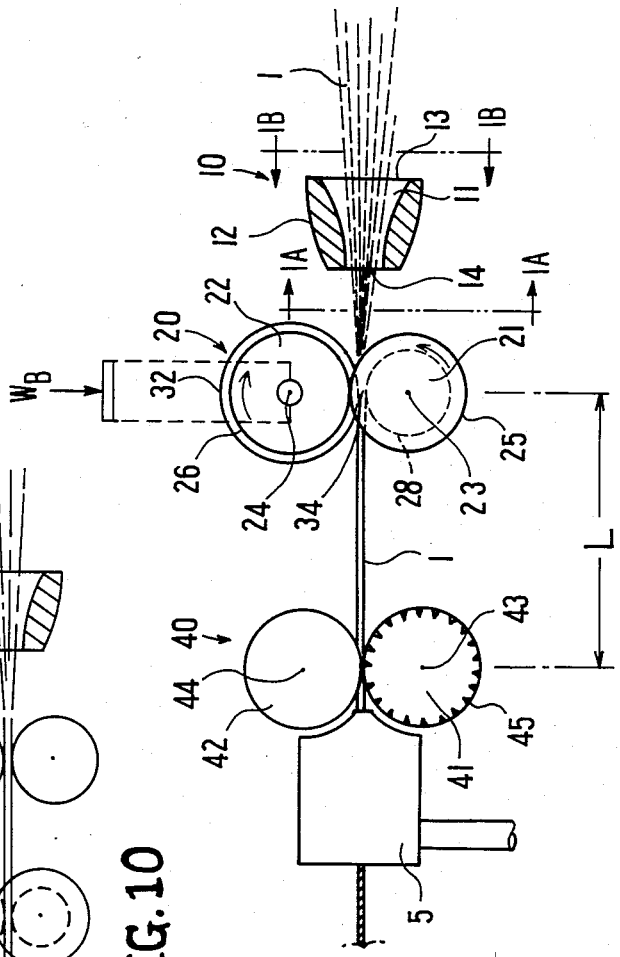
FIG. 1 is a schematic diagram in side elevation of a preferred embodiment of a drafting mechanism constructed according to the present invention.

Referring to FIG. 1, sliver, roving, or a bundle of fibers 1 is firstly passed through a collector generally designated by 10 and fed to a first roller arrangement generally designated by 20 where the sliver 1 undergoes pressing action thereby to be compacted. The sliver 1 thus pressed and compacted by the first roller arrangement 20 is then transferred to and received by a second roller arrangement 40, from which the fibers constituting the sliver 1 are further transferred to a spinning machine (not shown).

The first roller arrangement 20, which corresponds to the back rollers in a conventional roller drafting system, comprises a pair of rollers including a bottom roller 21 and a top roller 22 which are mounted on the machine rotatably about their respective axes 23, 24 parallel to each other and arranged in such relation that their respective circumferential peripheries or cylindrical surfaces 25, 26 may be placed in slight contact, or slightly spaced from each other, and that the sliver held by the nip by said pair of rollers may be pressed at a compaction ratio between ⅓ and 1/50 in the sectional plane of the sliver 1, perpendicular to the movement thereof. When the bottom and top rollers 21, 22 are disposed in contacting engagement, at least the circumferential peripheries 25, 26 thereof must be made of any suitable resiliently elastic material. The bottom roller 21 of said first pair 20 is provided in its circumferential periphery 25 at the medial part thereof with an annularly cut groove 30 comprising a recess 27 having a bottom cylindrical surface 28 and lateral inner wall surfaces 29 connected to said bottom surface 28 and forming the said edges of said recess 27, said groove 30 being concentric with the axis of rotation 23 of the bottom roller 21. On the other hand, the top roller 22 of the first pair 20 is formed on its circumferential periphery 26 at the corresponding medial part thereof with an integral annular projection 33 having lateral outer wall surfaces 31 which can be contactedly engaged with said edges and part of said lateral inner wall surfaces 29 of said groove 30 of the counterpart bottom roller 21 of the pair 20 and a top surface 32 which faces in opposed relation to said bottom surface of the groove 30 with a space 34 left therebetween at a point of engagement of the groove 30 of the bottom roller 21 and the projection 33 on the top roller 22, said projection 33 being concentric with the axis of rotation 24 of the top roller 22.

The bottom roller 21 and the top roller 22 of the first roller arrangement 20 are rotationally driven about their respective axes 23, 24 by any drive source (not shown) in a way similar to a back roller in a conventional roller drafting mechanism for transferring the sliver 1 toward a second pair of rollers 40 that follow and are to be described in later part hereof. The sliver 1 introduced into the groove 30 from the recess 27 of the bottom roller 21 is forcibly pressed by the associated bottom and top rollers 21, 22 and compacted in the space 34 substantially to conforms with the cross-section thereof, namely the cross-section as determined by the width measured between the opposite lateral inner wall surfaces 29 of the groove 30 and the depth measured between the bottom surface 28 of the groove 30 and the top surface 32 of the projection 33 engaged with said groove 30. Though the cross-sectional area of the compacting space 34 should vary depending on the kind of fibers to be handled and the thickness of sliver, the ratio at which the sliver under a free state is reduced to a compressed state according to the embodiment of the invention should fall within the range between ⅓ and 1/50, or preferably from 1/5 to 1/20. Pressing sliver at a high compaction ratio in the above range will make it necessary to establish a higher level of biasing load $W_B$ applied between the rotating shafts for the pressing rollers 21, 22 than the level heretofore applied to conventional drafting rollers. The extent of such biasing load $W_B$ is dependent on the kind of fibers, the size of the sliver, and the kind and quantity of oils contained in the sliver. As an example, when drafting a blend of polyester and cotton with 300 grains per six yards, about 10 kg of load $W_B$ has been heretofore applied between the roller shafts. Whereas, according to the embodiment of the present invention, 10 kg or more up to a maximum of about 50 kg is required to be applied selectively in connection with the compaction ratio.

Because the sliver 1 is thus subjected to a very high degree of pressing action by the compacting space 34 formed by the bottom and top rollers 21, 22, air present among the fibers of the sliver is forcibly squeezed out and the spaces between the fibers are placed under a vacuum, with the result that friction between the fibers of the sliver is increased to such an extent that the sliver 1 compacted in this way is formed substantially into a tight bar of fibers when it is transferred toward the following or second pair of rollers 40.

The second roller arrangement 40, which corresponds to and performs the same function as the front rollers in known roller drafting apparatus, comprises a pair of rollers including a bottom roller 41 having flutes formed extending in axial direction thereof on the entire circumferential periphery and a top roller 42 which is made of elastic material such as rubber or the like. Said bottom and top rollers 41, 42 are driven to rotate about their respective axes 43, 44 in opposite directions at the same peripheral speed and arranged so as to receive the sliver 1 which has been compacted by the preceding first pair of rollers 20. For the fibers in the sliver to be drafted and separated, the bottom and top rollers 41, 42 of the second pair 40 must be driven at a peripheral speed which is at least ten times as high as the peripheral speed at which the bottom and top rollers 21, 22 of the first pair 20 are driven to rotate. In the illustrated embodiment wherein two lines of paired rollers are employed, it is required that the second pair of rollers 40 should be operated to make still higher draft accounting for more than 30 or even greater than 50. The sliver 1 is placed under the influence of such drafting action in the zone between the first pair of pressing rollers 20 and the second pair of fast-running rollers 40, and separated into individual fibers accordingly.

Because the sliver 1 when compacted by the first pair of rollers 20 forces air contained among the fibers out thereof under application of a heavy pressing load, a vacuum state is created in the sliver 1 and the friction among fibers may be further increased under the influence of relative compression caused by the atmosphere. Therefore, the sliver 1 thus formed can maintain the same state as being held securely by and between the conventional afore-mentioned aprons even after it is released from the nip by the first pair of pressing rollers, with a result that drafting operations at a speed equal to or even higher than the speed obtainable from known roller drafting apparatus can be realized.

As a matter of course, the distance between the axes of the first pair of rollers 20 and the second pair of rollers 40, or the roller gauge designated by a reference letter symbol "L" in FIG. 1, is adjustable by any known adjusting means (not shown) to provide proper nip-to-nip distance according to the varying lengths of fibers to be handled.

When it is required to press a sliver by the first roller arrangement 20 at a relatively high compaction ratio within the afore-mentioned range of $\frac{1}{3}$ to 1/50, it is very helpful to provide a sliver collector at a position upstream of said first roller arrangement 20 for receiving and guiding the sliver 1, as well as for collecting the same to a width substantially equal to the widthwise dimension of the groove 30 of the bottom roller 21. In so doing, introduction of the sliver 1 into the groove 30 in the bottom roller 21 of the first pair 20 can be greatly facilitated. As illustrated particularly in FIGS. 1A and 1B, the collector comprises a frusto-conical shaped body 21 having a through-hole formed therein, said hole 11 having an inlet 13 opened to the upstream side with an opening which is substantially equal to or larger than the cross-sectional area of sliver in a free state before pressing, and an outlet 14 opened to the opposite downstream side with an opening whose width is substantially equal to or slightly smaller than the widthwise dimension of the groove 30 and whose area is equal to or smaller than the opening area of said inlet 13. By providing such a collector 10 on the upstream side of the first pair of rollers 20, the cross-section of the sliver can be reduced to a width which is small enough for the sliver 1 to be guided and introduced into the recess 27 of the groove 30, which serves to equalize the pressure to be applied to the sliver by the first pair of rollers 20 and also contributes to speed-up of the fiber drafting operation.

Figure 2:
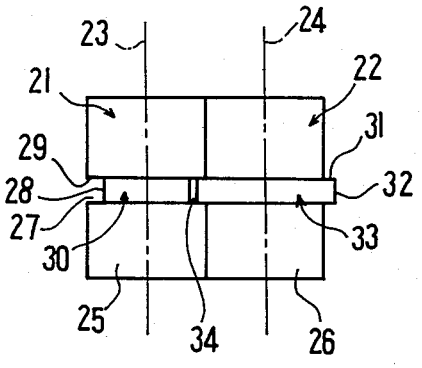
FIG. 2 is a front elevation showing a preferred embodiment of the first pair of rollers incorporating the present invention.
Figure 3:
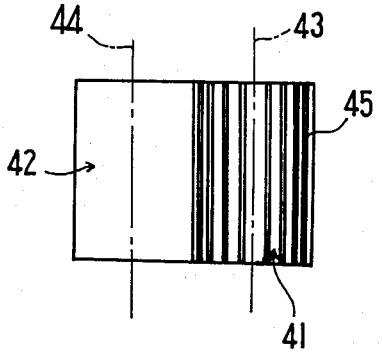
FIG. 3 is a front elevation showing the second pair of rollers in the embodiment of the invention.

FIG. 4 through FIG. 9 show in front views various modified forms of the combination of the bottom roller 21 and the top roller 22 of the first roller arrangement 20, respectively, with similar reference numerals given to those used in the previous preferred embodiment illustrated in FIG. 1 and FIG. 2.

Figure 4:
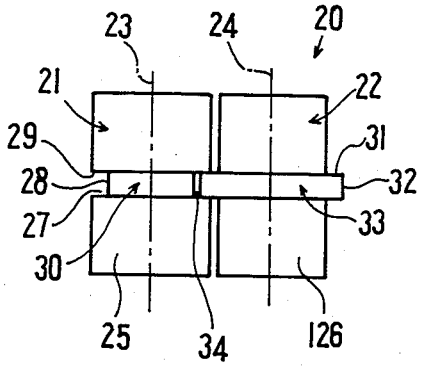
FIG. 4 through FIG. 9 are similar to FIG. 2, but showing various modified configurations of the first pair of rollers.

Referring to FIG. 4, the bottom roller 21 is configured exactly in the same form as the counterpart in FIG. 2, but the top roller 22 in this modified embodiment differs in that the radius of curvature of the circumferential periphery 126 thereof is made smaller than that of the periphery 26 in FIG. 2 so that the former periphery 126 may be spaced slightly away from the opposite circumferential periphery 25 of the bottom roller 21.

Figure 5:
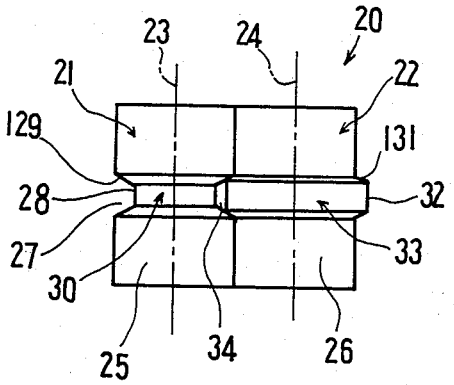

Referring then to FIG. 5, the bottom roller 21 thereof is provided with a groove 30 having lateral inner wall surfaces 129 which are inclined in such a way that said groove 30 is formed divergent along a direction which is directed away from the bottom surface 28 of the groove 30. The mating top roller 22 is provided with a projection 33 whose lateral outer wall surfaces 131 are so inclined that they may fit snugly with the same inclination of said lateral inner wall surfaces 129 of the groove 30.

Figure 6:
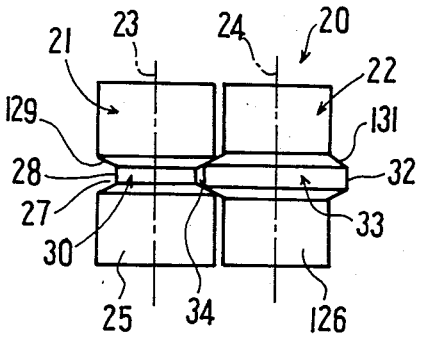

The pair of associated bottom and top rollers 21, 22 shown in FIG. 6 is similar to the pair described just previously in FIG. 5, but differs therefrom in that the circumferential periphery 126 has a smaller radius of curvature so that it is spaced slightly away from the opposing circumferential periphery 25 of the bottom roller 21.

Figure 7:
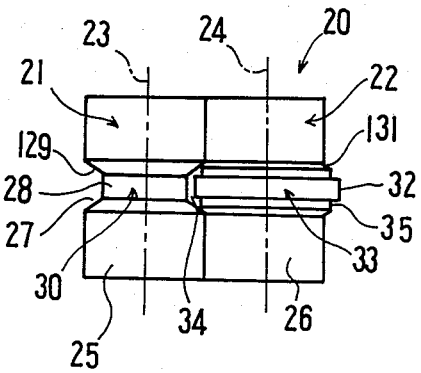

In the first pair of rollers 20 in the embodiment in FIG. 7, the bottom roller 21 of the pair has quite the same configuration as the counterpart in previous FIG. 5, but the top roller 22 has additional stepped portions 35 which are formed by cutting away both edges of the top surface 32 on the projection 33 in FIG. 5.

Figure 8:
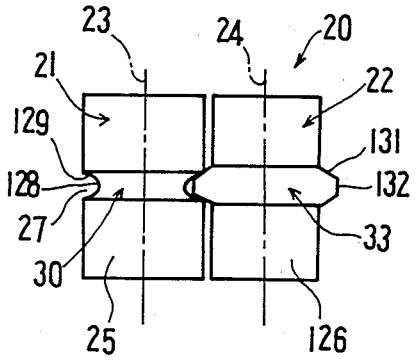

Referring now to FIG. 8, the portion in this modified configuration corresponding to the bottom surface 28 of the groove 30 in FIG. 6 is formed into an arc-shaped bottom surface 128 connected continuously to the lateral inner wall surfaces 129, while the projection 33 on the top roller 22 has a similarly arc-shaped top surface 132 whose effective radius of curvature is greater than that of the arc of said bottom surface 128 and which is connected continuously to the inclined lateral outer wall surfaces 131 to permit a snug fit of said groove 30 and the projection 33.

Figure 9:
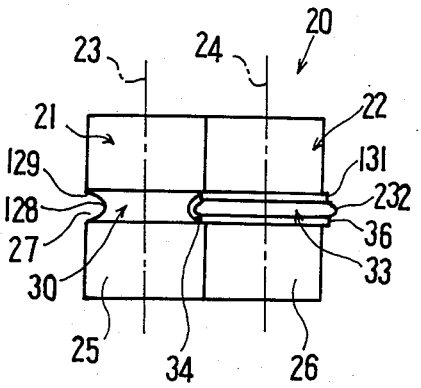

The last illustrated modification in FIG. 9 includes a bottom roller 21 which is configured in the same form as its counterpart in the previous embodiment in FIG. 8 and a top roller 22 whose circumferential periphery 26 is sized large enough to be in contact with the opposite circumferential periphery 25 of the bottom roller 21 and whose projection 33 has an arc-shaped top surface 232 with a radius of curvature smaller than that of the bottom surface 128 of the groove 30 of the bottom roller 21 and is formed with stepped portions 36 between said top surface 232 and the lateral outer wall surfaces 131.

As shown clearly in the drawings, the compacting spaces 34 according to the embodiments in FIG. 2 and FIG. 4 are formed in rectangular section; the spaces 34 in FIG. 5 and FIG. 6 in trapezoid-shaped section; and the spaces 34 in FIG. 7 through FIG. 9 in substantially arc-shaped section. As to the rectangular and trapezoid section, the space 34 having a section with a smaller depth-to-width ratio may be advantageously used in combination with a ring spinner; while the space 34 with a greater depth-to-width section is suitable for use in combination with a spinner for producing fasciated yarn. The arc-shaped section of the compacting space 34 which causes the sliver to be flattened across its section can offer better drafting results when applied to a spinner for producing fasciated yarn. In the modified embodiments shown in FIG. 8 and FIG. 9, the bottom roller 21 and the associated top roller 22 are driven at such a speed that the mean peripheral speed between the bottom surface 128 of the groove 30 of the bottom roller 21 and a point in part of the lateral inner wall surface 129 thereof may be equal to the mean peripheral speed between the top surface 232 of the projection 33 of the top roller 22 and the stepped portion 36 thereof.

The modified first roller arrangements 20 shown in FIGS. 4, 6 and 8 wherein a space is provided between the circumferential peripheries 25, 126 are advantageous over the other embodiments in drafting operations conducted at higher speeds, because the contact area between the bottom and top rollers 21, 22 is reduced to a minimum in the latter arrangements.

In the embodiments illustrated so far, two lines of paired rollers 20, 40 are employed and the fibers drafted are formed into a strand of spun yarn immediately upon being released from the drafting zone defined between said two lines. When the drafting apparatus according to the embodiment of the invention is utilized for a spinner for fasciated yarn, therefore, a pneumatic false twister 5 is disposed adjacently and on the downstream of the second pair of rollers 40.

Figure 10:
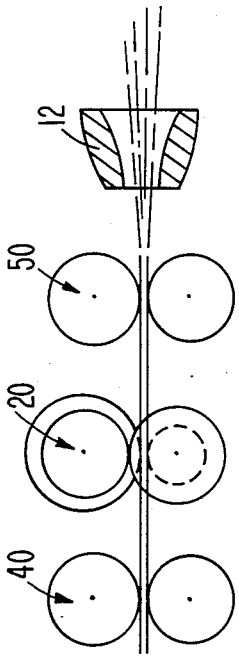
FIG. 10 is a schematic showing, similar to FIG. 1, of a modified form of the invention.

As shown in FIG. 10, it can be contemplated to provide an additional pair of rollers 50 on the upstream side of the first pair 20. Such addition of rollers can make possible still higher draft of fibers.

As it is now apparent to those skilled in the art, the present invention consists in drafting of textile fibers by compacting a sliver of fibers by means of a first pair of rollers and then by placing such compacted fibers under the action of drafting between the first pair of rollers and another second pair of rollers, whereby fibers with increased friction thereamong can be held and supported without use of any auxiliary means such as aprons.

The drafting method embodied according to the present invention is accomplished by a series of steps comprising feeding a sliver continuously to a first roller arrangement including at least a pair of cooperating rollers, pressing said sliver through its sectional plane across the movement thereof by and between said pair of rollers to reduce the cross-section of the sliver and compact the same for increasing the friction among the fibers, transferring such compacted sliver to a second roller arrangement including a pair of rollers for holding the same and feeding out fibers of the sliver from said second pair of rollers at a speed which is more than ten times higher than the speed at which the sliver has been fed out from said first pair of rollers, whereby the fibers in the sliver are separated into individual fibers under drafting action exerted thereto in the drafting zone defined by said first pair of rollers and said second pair of rollers. Therefore, fiber drafting can be performed not only in the same manner as it is done between the back rollers and front rollers in conventional roller drafting system, but also when the sliver is subjected to drafting action due to said difference in speed between the first rollers and the second rollers, the fibers in the sliver can be held securely with no free fiber pieces even without use of any auxiliary support means such as aprons, because the pressing and compacting action by the first rollers creates vacuum in the sliver by squeezing out air present among fibers thereby to compress the sliver further under the influence of the relatively pressurized atmosphere with a resulting increase of the fiber-to-fiber friction in the sliver. Furthermore, because the sliver may be compacted extremely uniformly merely by pressing the sliver continuously by means of a pair of rollers constructed according to the embodiment of the invention, fiber separation at an extremely high draft is practically possible with the least irregularity in draft. Accordingly, the fiber drafting method of the present invention can be advantageously utilized in sliver-to-yarn spinning which handles thick sliver, e.g., of 100 to 300 grains per six yards.

The degree of pressure to be applied in pressing to compact the sliver by the first pair of rollers is selectively established depending on the kind of fibers to be drafted, the thickness of sliver, and the kind and quantity of oils contained in fibers. Generally speaking, insufficiency of pressure application will cause lack of friction among fibers, but increasing the pressure futher than a certain level will not contribute much to compacting effect. According to our experiment, reduction of sliver section across the movement thereof by pressing in the range of $\frac{1}{3}$ and 1/50 of compaction ratio has proved to bring about desirable drafting results, and more remarkable results could be obtained from reduction at a compaction ratio between 1/5 and 1/20.

On the other hand, the fiber drafting apparatus constructed according to the invention comprises a first pair of rollers mounted rotatably about their respective parallel axes, one roller of which has an annular groove recessed toward the axis of rotation thereof in the circumferential periphery and having a bottom surface and lateral inner wall surfaces adjacent to said bottom surface, and the other roller of which has an integral annular projection having lateral outer wall surfaces which can be brought into contact with part of said lateral inner wall surfaces of the groove and a top surface which can face in opposition to the bottom surface of the groove with a slight space formed between said bottom surface of the groove and said top surface of the projection, for pressing and compacting the sliver fed into the groove. A second pair of rollers is disposed at a position on the downstream side of said first pair and spaced therefrom by a predetermined distance and mounted rotatably about their respective parallel axes for holding the sliver which has been transferred from said first pair of rollers. Drive means rotate said first pair of rollers in direction which causes the sliver to be fed forwardly, and drive means rotate said second pair of rollers in the same forward direction to deliver the fibers in the sliver at a speed which is more than ten times higher than the speed at which the sliver is fed out by said first pair of rollers. Thus, the sliver passed through said first pair of rollers is pressed and compacted in the space formed between the bottom surface of the groove provided in said one roller and the top surface of the projection provided on said other roller in the first pair of rollers, and then transferred to and nipped by said second pair of rollers which are driven at such a speed that drafting action is created in the zone defined between said first and second pairs of rollers.

In this way, an object of the invention, to dispense with fiber supporting aprons in fiber drafting apparatus, can be accomplished merely by driving a pair of rollers cooperating so as to press and compact the sliver. Furthermore, because the structure of the drafting apparatus of the present invention is so simple, it can resist continuous drafting operations at a high speed for a substantially prolonged period of time. In addition, because the use of elements such as aprons, which are susceptible to damage or are breakable after a relatively short period of service, may be avoided. The fiber drafting operation can be performed with a high standard of reliability and the least irregularity in draft and at a high speed and high draft.

While the invention has been illustrated and described with reference to various specific embodiments thereof, it is to be understood by those skilled in the art that various changes in the details of construction or configuration may be made without departing from the spirit and scope of the invention.

What I claim is:

1. Method of drafting textile fibers of sliver, roving or the like in a drafting apparatus including at least two pairs of drafting rollers, the first pair of which comprises rollers supported rotatably on their respective axes parallel to each other and driven positively in opposite directions of rotation to feed said fibers forwardly in said drafting apparatus, and the second pair of which comprises rollers spaced downstream from said first pair of rollers, mounted rotatably on their respective axes parallel to each other and driven positively in the same direction of rotation as the counterparts of said first pair but at a peripheral speed which is set higher than that of said first pair, said first and second pairs of rollers providing one and the other nips for the sliver to be drafted and thereby forming a fiber drafting zone therebetween, said method comprising:

feeding the sliver to said first pair of rollers while rotating the same;

pressing said sliver by and between the rotating rollers of said first pair using compressive force within the range of from about 10 kg to about 50 kg so as to compact the sliver for reducing its cross-sectional area to from about ⅓ to about 1/50 of its initial cross-sectional area and thereby increasing the friction among the fibers of said sliver, and feeding such compacted sliver to said second pair of rollers;

receiving and holding the thus compacted sliver by and between the rollers of said second pair while rotating the same at a speed of at least ten times (10×) that of said first pair of rollers to feed out the drafted fibers therefrom.

2. Method as set forth in claim 1, said method further comprising the additional step of guiding and collecting the fibers of sliver in advance of said pressing between said first pair of rollers.

3. Method as set forth in claim 1, wherein said pressing is performed such that said cross-sectional area of the sliver is reduced to from about 1/5 to about 1/20 of its initial cross-sectional area.

4. Method as set forth in claim 1, which further comprises converging both of the respective end portions of said sliver cross-sectional area inwardly and downwardly towards and upon the central portion thereof during said pressing of the sliver between said rotating first pair of rollers.

5. Apparatus for drafting textile fibers of sliver, roving or the like, comprising:

a first pair of rollers supported rotatably on their respective axes parallel to each other and driven positively in opposite directions of rotation to feed said sliver forwardly in said apparatus, one roller of which has an annular groove recessed toward the axis of rotation thereof in the circumferential periphery thereof and having a bottom surface and lateral inner wall surfaces, and the other roller of which has an annular projection formed on the circumferential periphery thereof and having lateral outer wall surfaces for engagement with part of said lateral inner wall surfaces of said groove of said one roller and a top surface facing said bottom surface of said groove of said one roller in opposite relation thereto and providing a space between said bottom surface of the groove of said one roller and said top surface of the projection of said other roller when said rollers are in engagement relation;

drive means for rotating said first pair of rollers at one speed;

means for applying compressive force within the range of from about 10 kg to about 50 kg urging said first pair of rollers together during said rotation thereof for pressing the sliver fed into said groove so as to compact the same for reducing its cross-sectional area and thereby increasing the friction among the fibers of said sliver;

a second pair of rollers arranged downstream in spaced relation from said first pair of rollers and supported rotatably on their respective axes parallel to each other for receiving and holding therebetween the compacted sliver received from said first pair of rollers and substantially simultaneously delivering the drafted fibers therefrom; and means for rotating the rollers of said second pair at a speed which is at least ten times (10×) higher than that of said first pair of rollers.

6. Apparatus as set forth in claim 5, further comprising a collector located upstream of said first pair of rollers and having a through-hole sliver guide formed therein in the direction of movement of the sliver, said through-hole sliver guide having an outlet opening on the side thereof adjacent to said first pair of rollers whose width as measured parallel to said axes of the rollers of said first pair is substantially equal to or smaller than the widthwise dimension of said annular groove of said one roller of the pair and an inlet opening whose sectional area across the direction of movement of the sliver is larger than that of its said outlet opening for guiding and simultaneously collecting the sliver as it is fed therethrough.

7. Apparatus as set forth in claim 5, further comprising an additional pair of cooperating rollers upstream of said first pair of rollers.

8. Apparatus as set forth in claim 5, wherein said groove in said one roller of the first pair of rollers and the corresponding projection on said other roller in the same first pair are respectively shaped such that said space formed by and between the bottom surface of said groove and the top surface of said projection when said pair of rollers are in engagement has substantially rectangular shape.

9. Apparatus as set forth in claim 5, wherein the groove in said one roller of the first pair of rollers and the corresponding projection on said other roller in the same first pair are respectively shaped such that said space formed by and between the bottom surface of said groove and the top surface of said projection when said pair of rollers are in engagement has substantially trapezoidal shape.

10. Apparatus as set forth in claim 5, wherein the groove in said one roller of the first pair of rollers and the corresponding projection on said other roller in the same first pair are respectively shaped such that said space formed by and between the bottom surface of said groove and the top surface of said projection when said pair of rollers are in engagement has substantially arcuate shape.

11. Apparatus as set forth in claim 5, wherein a pneumatic false twisting apparatus is disposed downstream of and adjacent to said second pair of rollers for receiving drafted fibers therefrom.

12. A method of continuously drafting textile fibers of sliver, roving or the like comprising compacting the sliver, roving or the like in both height and width to a cross-sectional area of from about $\frac{1}{3}$ to about 1/50 of its initial area using a compacting force within the range of from about 10 kg to about 50 kg as it is drawn at a compacting speed into a drafting zone, and then drafting the compacted sliver, roving or the like at a speed of at least ten times (10×) said compacting speed.

* * * * *